US005815967A

United States Patent [19]

Alvern

[11] Patent Number: 5,815,967

[45] Date of Patent: Oct. 6, 1998

[54] DISPLAY DEVICE FOR A FLUID FILLER GUN INCLUDING A COMMUNICATION APPARATUS

[75] Inventor: Stein Alvern, Houston, Tex.

[73] Assignee: Alvern-Norway A/S, Norway

[21] Appl. No.: 790,582

[22] Filed: Jan. 29, 1997

Related U.S. Application Data

[63] Continuation-in-part of Ser. No. 590,407, Jan. 25, 1996.

[51] Int. Cl.[6] ..... B67D 5/06

[52] U.S. Cl. ..... 40/299; 223/23; 141/392; 141/98; 40/455

[58] Field of Search ..... 40/299, 455, 457; 223/23; 141/392, 98

[56] References Cited

U.S. PATENT DOCUMENTS

| | | |
|---|---|---|
| D. 173,006 | 9/1954 | Anderson . |
| D. 173,007 | 9/1954 | Anderson . |
| D. 279,483 | 7/1985 | Goldman . |
| D. 279,484 | 7/1985 | Goldman . |
| D. 366,310 | 1/1996 | Fell . |
| 4,408,791 | 10/1983 | Griffin et al. . |
| 4,465,209 | 8/1984 | Wilder . |
| 4,690,182 | 9/1987 | Knaus . |
| 5,058,637 | 10/1991 | Fell . |
| 5,184,309 | 2/1993 | Simpson et al. . |
| 5,184,655 | 2/1993 | Fell . |

FOREIGN PATENT DOCUMENTS

| | | |
|---|---|---|
| AU-S-122642 | 2/1995 | Australia . |
| AU-S-123343 | 5/1995 | Australia . |
| 0407271A1 | 1/1991 | European Pat. Off. . |
| 62-208396 | 9/1987 | Japan . |
| 850627 | 10/1992 | Japan . |
| 1393062 | 5/1975 | United Kingdom . |
| 2147273 | 5/1985 | United Kingdom . |
| WO 90/08375 | 7/1990 | WIPO . |

*Primary Examiner*—Cassandra H. Davis
*Attorney, Agent, or Firm*—Finnegan, Henderson, Farabow, Garrett & Dunner, L.L.P.

[57] ABSTRACT

A display device for a fluid filler gun head includes a carrying body and a frame attached to an upper surface of the carrying body, defining a display portion for removable display placards. The carrying body can be removable from the gun head or may be an integral part of the gun head itself. A housing is defined in the carrying body for housing a communication apparatus. The communication apparatus can include a recorder assembly for playing prerecorded audible messages, or a transmitter/receiver assembly enabling communication between a consumer using the fluid filler gun and a remote service station attendant.

24 Claims, 15 Drawing Sheets

FIG. 19
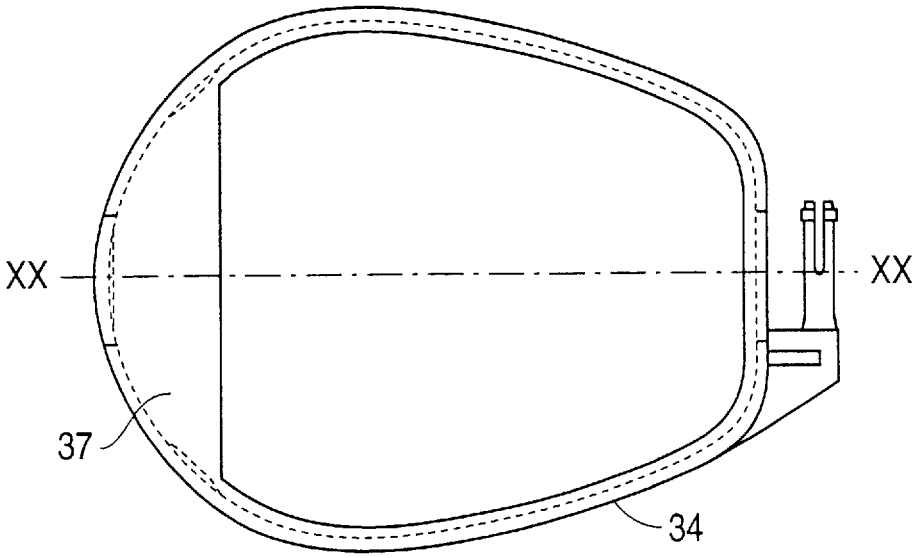
FIG. 20
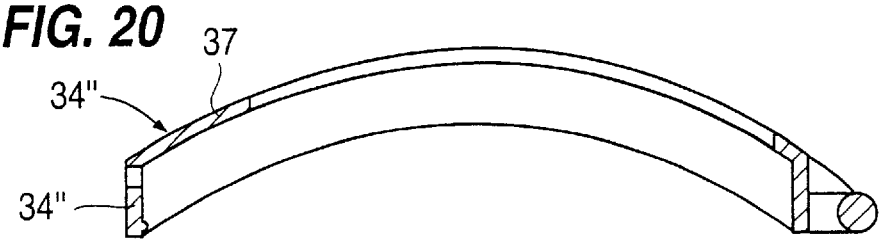
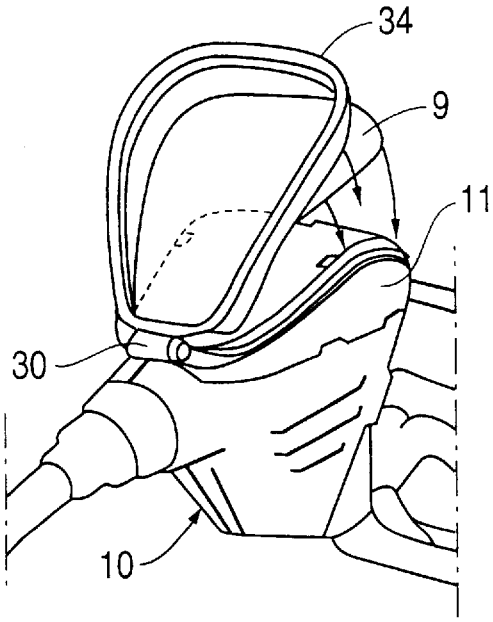
FIG. 21
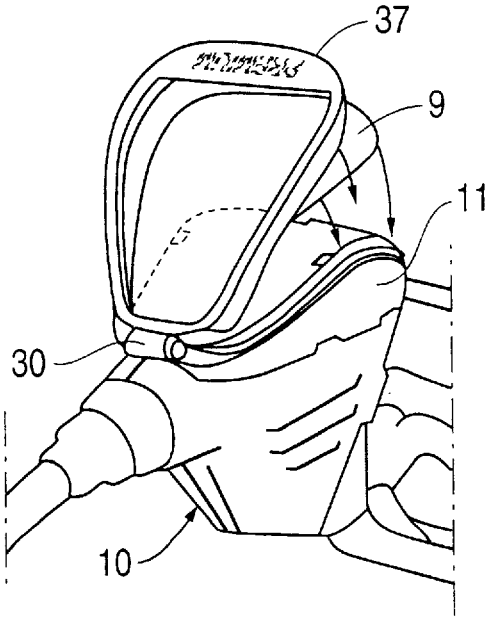
FIG. 22

DISPLAY DEVICE FOR A FLUID FILLER GUN INCLUDING A COMMUNICATION APPARATUS

This application is a continuation-in-part of U.S. patent application Ser. No. 08/590,407, filed Jan. 25, 1996 now pending.

BACKGROUND OF THE INVENTION

1. Field of the Invention

The present invention relates to a display device for a fluid filler gun. More particularly, the present invention relates to a display device including a communication apparatus, such as a radio transmitter and receiver, or a recorder, for improved communication in a self-serve automobile service station.

2. Description of the Related Art

Self-serve automobile service stations are well known. A driver pulls his automobile up to one of several service islands, where he can service his automobile with, e.g., gasoline, oil, washer fluid, air, water, and so on. These fluids typically are dispensed from filler guns attached via hoses to fluid pumps. A service station attendant is typically on duty at the station, in a location that is remote from the service islands.

It also is known to provide display devices on filler guns. A pliable plastic or rubber boot slides in place over the gun head. The boot protects the paint on the automobile from contact with the filler gun head. The boot may include a small display surface where replaceable display placards can be mounted for advertising services or products.

In the self-serve station described above, the consumer occasionally needs to talk to the station attendant, either about the services the consumer needs, or the information being displayed on the display device. Such communication is difficult because the attendant is in a remote location.

Therefore, the consumer must leave the service island and find the attendant, which is time-consuming and undesirable.

SUMMARY OF THE INVENTION

The present invention is provided to correct one or more of the above-described shortcomings in the conventional devices.

In accordance with the invention, a display device is attachable to a fluid filler gun, the filler gun including a barrel, a gun head, and a handle. The display device includes a carrying body removably attachable to the gun head, the carrying body including side portions and an upper portion having an upper surface. A frame is attached to the upper portion of the carrying body, the frame and the upper surface of the carrying body defining a display portion for holding a removable display placard. A communication housing is defined in the carrying body, and a communication device is provided in the housing.

The communication device can include any one, two, or all of the following: a radio transmitter assembly, a radio receiver assembly, and a recorder assembly. The communication device further includes a speaker unit mounted in the carrying body.

In another embodiment of the invention, a fluid filler gun is provided, including a barrel, a gun head, and a handle. The gun head includes side walls and an upper surface, with the carrying body of the display device being an integral part of the upper surface of the gun head. A frame is attached to the upper surface of the gun head, defining a display portion for holding a removable display placard. A communication housing is defined in the gun head, and a communication apparatus is mounted in the housing.

Additional objects and advantages of the invention will be set forth in the general description given above and the detailed description below, or may be learned by practice of the invention. The objects and advantages of the invention may be realized by means of the combinations set forth in the attached claims.

BRIEF DESCRIPTION OF THE DRAWINGS

The accompanying drawings, which are incorporated in and comprise a part of the specification, illustrate embodiments of the invention, and together with the description, serve to explain the principles of the invention.

FIG. 19 shows a top plan view of a modification of the top member of FIG. 16;

FIG. 20 is cross-section XX—XX of FIG. 19;

FIG. 21 illustrates in a perspective view the display apparatus installed on a filler gun with a top member according to FIG. 16;

FIG. 22 shows in perspective view a display apparatus according to the present invention installed on a filler gun and with a top member according to FIG. 19;

DETAILED DESCRIPTION OF THE PREFERRED EMBODIMENTS

Reference will now be made in detail to the present preferred embodiments of the invention as illustrated in the accompanying drawings.

Figure 1:
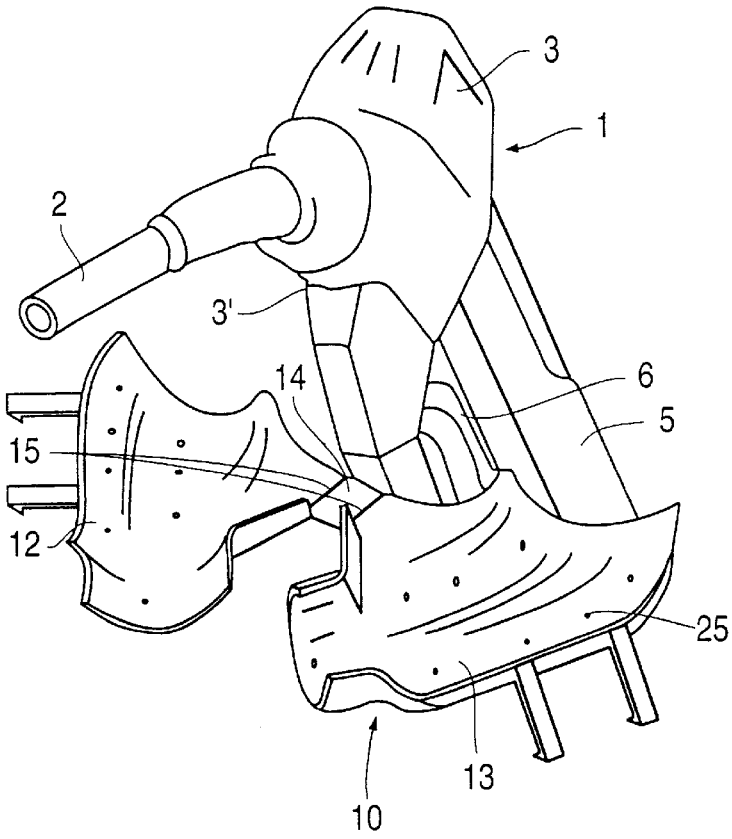
FIGS. 1 and 2 illustrate fitting of a lower member of the carrying body of the present invention onto a filler gun head.
Figure 2:
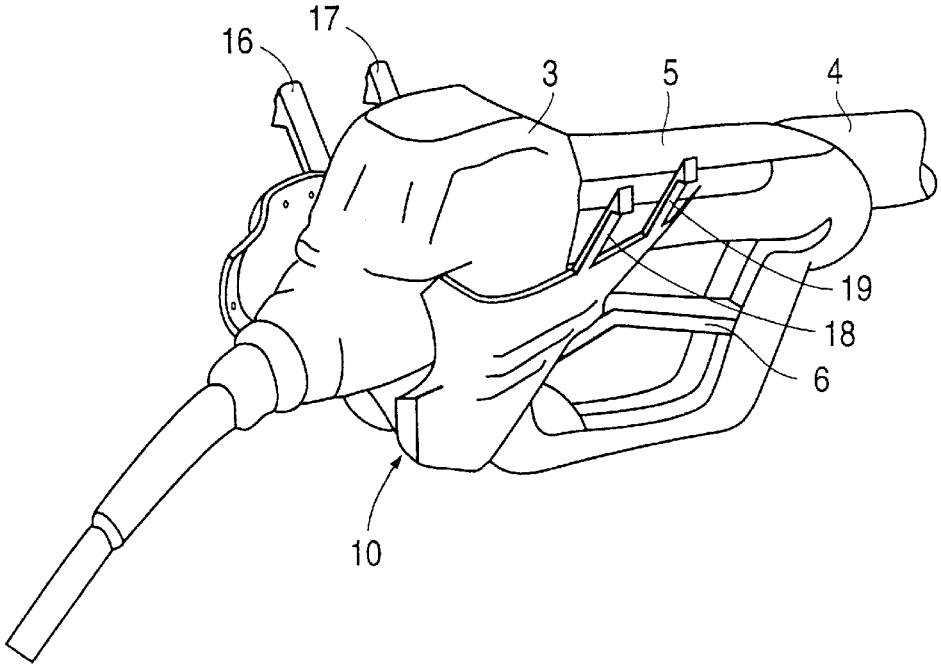

FIGS. 1 and 2 show a filler gun 1 of a fluid pump, for example, a fuel pump, oil pump, water pump, or the like. The filler gun includes a fluid gun nozzle 2 for discharging fluid at its front end and a gun head 3 having internally located a fluid valve means (not shown). The valve outlet means communicates with the nozzle 2 and valve inlet means (not shown) communicates with fluid supply means connected to a fluid hose 4, the fluid supply means extending through a handle 5 of the gun. The handle 5 has lever means 6 which are operatively connected to the valve means. The gun head 3 may be of an unprotected type, or may be covered by a protective boot of rubber or plastic material as indicated by reference number 3'.

Figure 4:
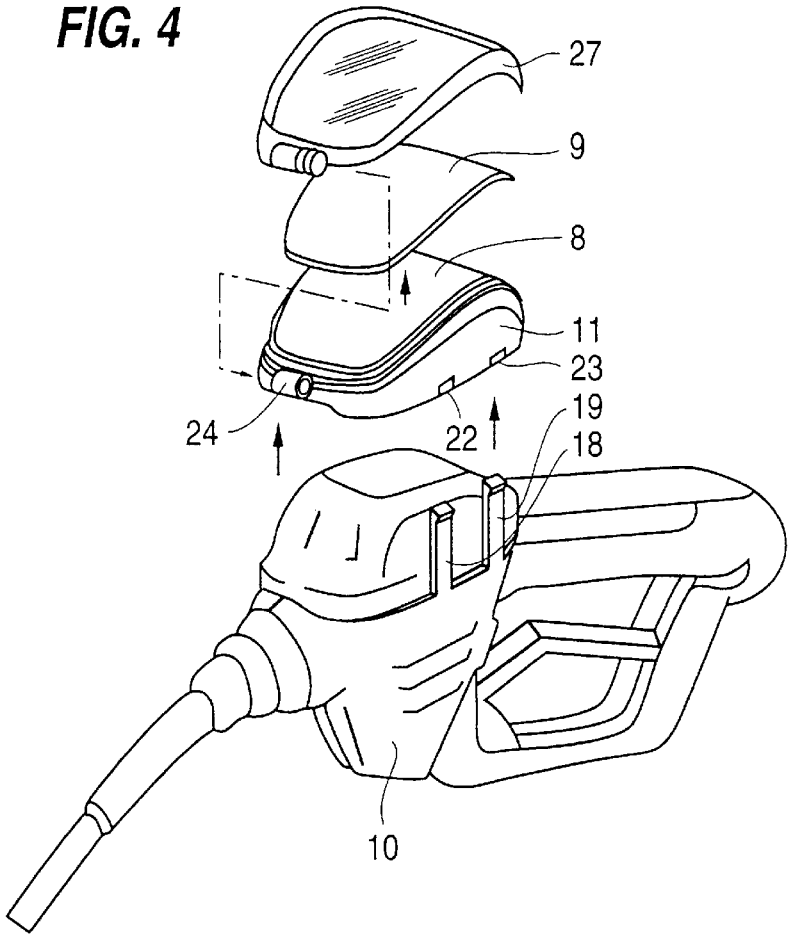
FIG. 4 further illustrates mounting of the upper member onto the filler gun and with pivotable engagement of a top with the upper member.
Figure 5:
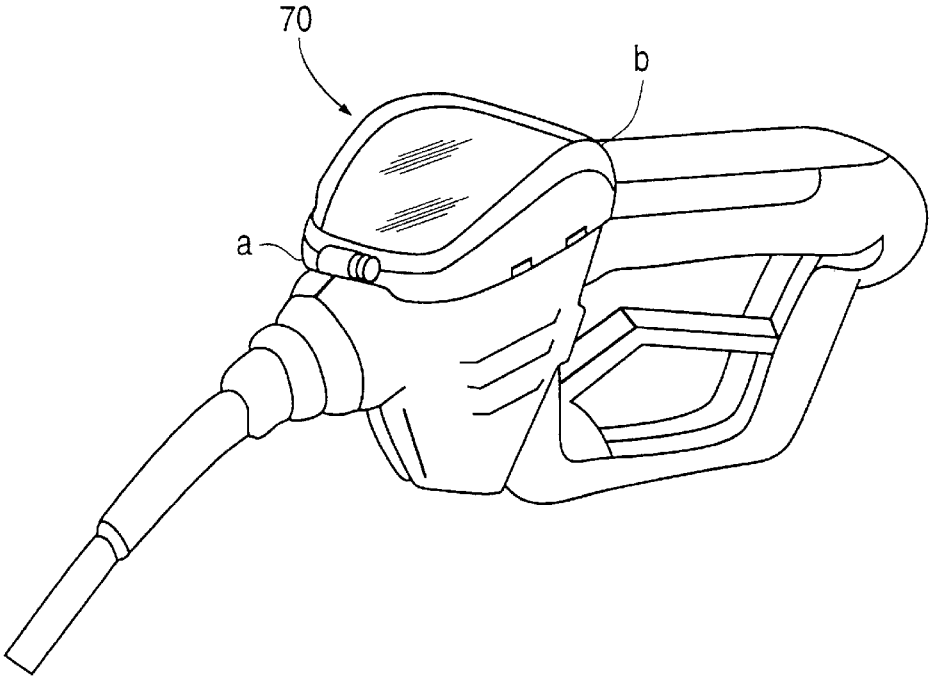
FIG. 5 shows a carrying body with the top member fully installed on the filler gun.

As shown in FIGS. 4 and 5, the filler gun is provided with a display apparatus, generally denoted by reference number 70. Such display apparatus is intended for supporting on its upper surface 8 a message card 9 for displaying a graphic message readily viewable by a filler gun user.

As clearly shown in FIGS. 4 and 5, the carrying body 7 for the graphic message is adapted to fit over the filler gun to extend from approximately the junction "a" of the gun nozzle 2 with the gun head 3 to approximately the junction "b" of the gun head 3 with a forward end of the handle 5. The display surface 8 for the graphic message, when the carrying body 7 is attached to the filler gun, extends longitudinally along the filler gun from approximately the junction "a" of the gun head 3 with the nozzle 2 to approximately the junction "b" of the gun head with a forward end of the handle of the gun.

Persons skilled in the art will recognize the gun head 3 often is covered with a flexible rubber or plastic boot. These flexible boots are provided with gasoline filler guns to prevent the gun head, upon insertion into an automobile gas tank, from scratching the automobile's paint. The carrying body 7 is dimensioned such that it can attach or slide over gun head 3 with the flexible boot either in place or removed.

As clearly seen from FIGS. 1–5, the carrying body 7 comprises a lower member 10 and an upper member 11 releasably engageable with the lower member 10. The lower member 10 has two side panels 12, 13, a bottom element 14, and means 15, such as film hinges or other transition means, integrally connecting side panels 12, 13 with the bottom element 14. As shown in FIG. 2, the lower member 10 with its side panels 12, 13 and bottom element 14 are brought to lie against the gun head 3 substantially fitting around a lower part of the gun head. At the top region of the side panels there are first interlocking means 16, 17 and 18, 19 on the respective panels 12 and 13. The first interlocking means 16–19 are suitably formed as male elements in the form of snap hooks.

Figure 3:
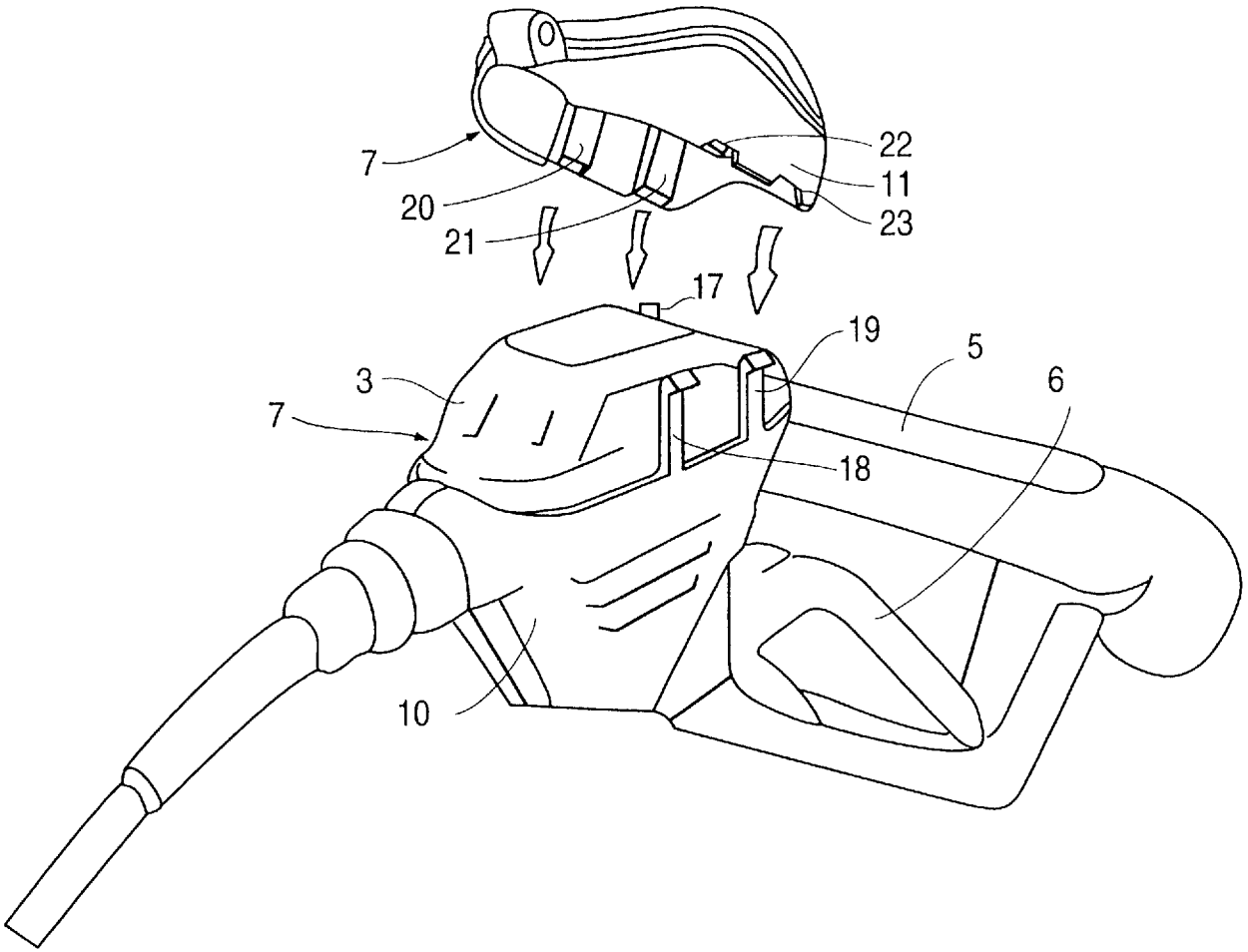
FIG. 3 illustrates fitting of an upper member of the carrying body onto the filler gun head through engagement with the lower member.
Figure 10:
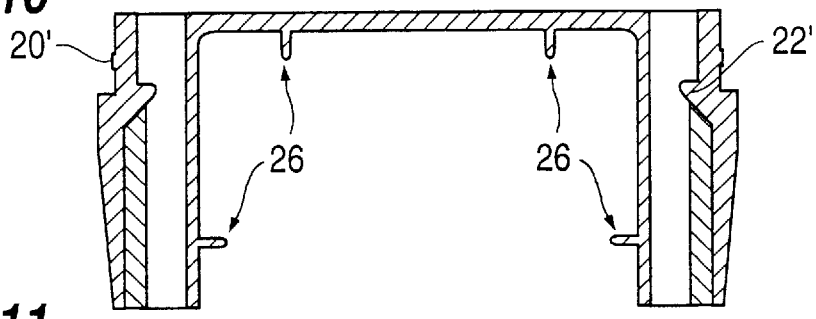
Figure 11:
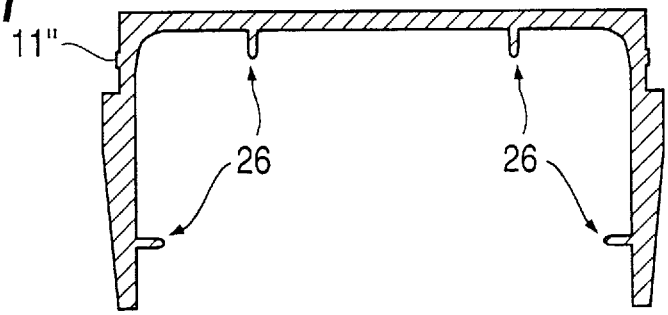

As seen from FIGS. 3 and 4, the upper member 11 is formed as cap-like means to fit over an upper part of the gun head 3. The upper member 11 has second interlocking means 20, 21 and 22, 23 for releasably engaging the first interlocking means 16, 17 and 18, 19, respectively, on the lower member. The second interlocking means are formed as female elements having means, e.g., in the form of a ledge or set-off 20', 21', 22', 23' as indicated more closely in FIGS. 7, 8 and 10. FIG. 1 shows that the panels 12, 13, bottom element 14, connecting means 15, and first interlocking means 16–19 are formed as an integrally made structure, e.g., through an injection molding process.

Figure 14:
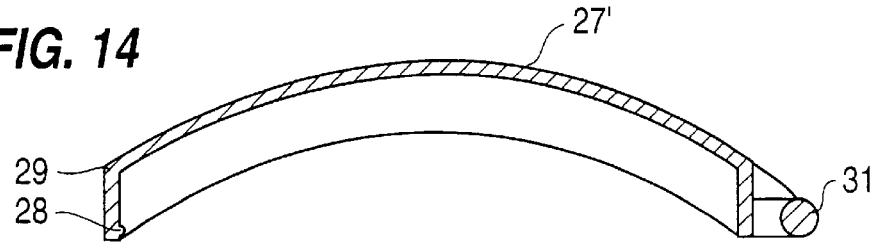
FIG. 14 is cross-section XIV—XIV of FIG. 13.
Figure 15:
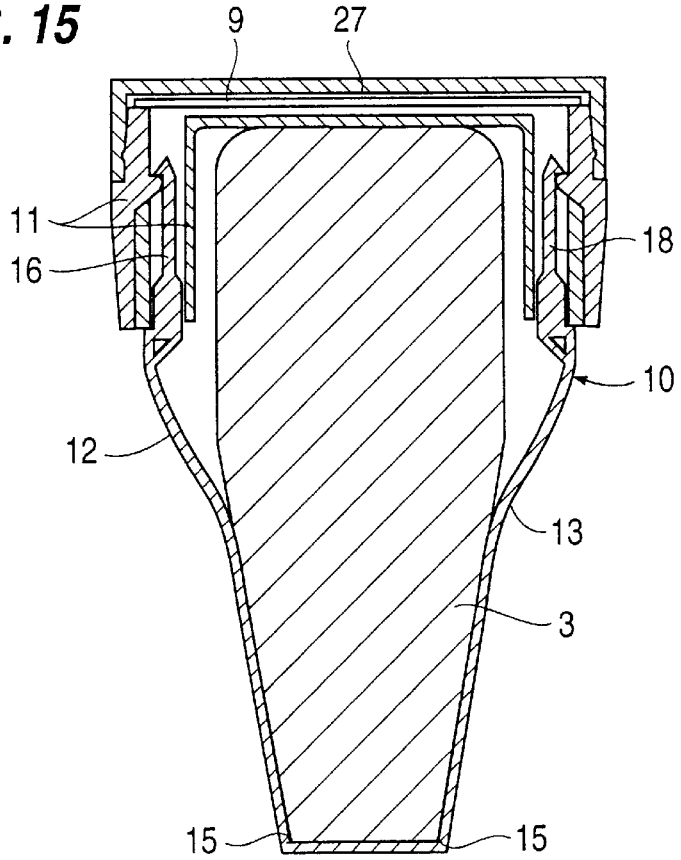
FIG. 15 is a cross-section through the display apparatus with the top member of FIG. 13 and installed on a filler gun.

As seen from FIG. 6, the upper member 11 has an upper peripheral portion 11'with a bead 11" extending along the upper peripheral portion 11' for releasably engaging a peripheral skirt portion of a top member located on the upper member 11, as will be explained further with reference to FIGS. 13–15.

At a forward end of the upper member, there is provided a first hinge means 24 in the form of a protruding member having a transverse hole 24'.

As illustrated in FIGS. 1 and 2, side panels 12, 13 may be provided with a plurality of integrally made studs 25 which both compensate for any tolerances in the space between the panels 12, 13 and the gun head 3 as well as being able to penetrate partly into any protective boot provided on the gun head. Thus, when fitted around the gun head 3, the lower member 10 may obtain an improved contact with the gun head 3.

Similarly, as indicated in FIGS. 8–11, the upper member 11 may have similar or technically equivalent space compensating studs, generally denoted by reference number 26. The studs should be so dimensioned that they will easily yield and/or penetrate into the soft protective boot covering the gun head if so provided.

Figure 12:
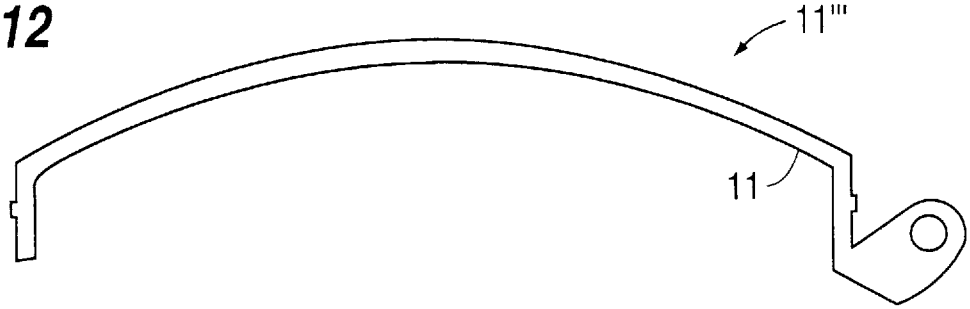

FIG. 12 discloses that the top face 11'" of the upper member 11 has a curved configuration along its length. In a first embodiment, the top member shown in FIG. 4 and also in FIG. 13, is labeled with reference number 27 and is formed as a lid with a transparent face portion 27' for viewing a message on the message card 9. The top member 27 has means in the form of thickened portions 28 on a peripheral skirt portion 29 depending from the transparent face portion 21' designed to engage the bead 11' on the upper member 11. Space is provided between an upper surface of the upper member 11 and a portion of the top member 27 in order that the replaceable message card 9 can be located in such space when the top member 27 and the upper member 11 engage, as illustrated in FIG. 15. FIG. 15 shows how the lower member 10, with its side panels 12, 13 and the first interlocking means 16, 18, is capable of snap locking to the upper member 11.

The top member 27 is suitably provided with a second hinge means 30 engageable with the first hinge means 24 on the upper member 11 for pivotable attachment of the top member 27 to the upper member 11. The second hinge means has a protrusion integral with a pin 31, having a slit 32 and a thickened end 33.

Figure 16:
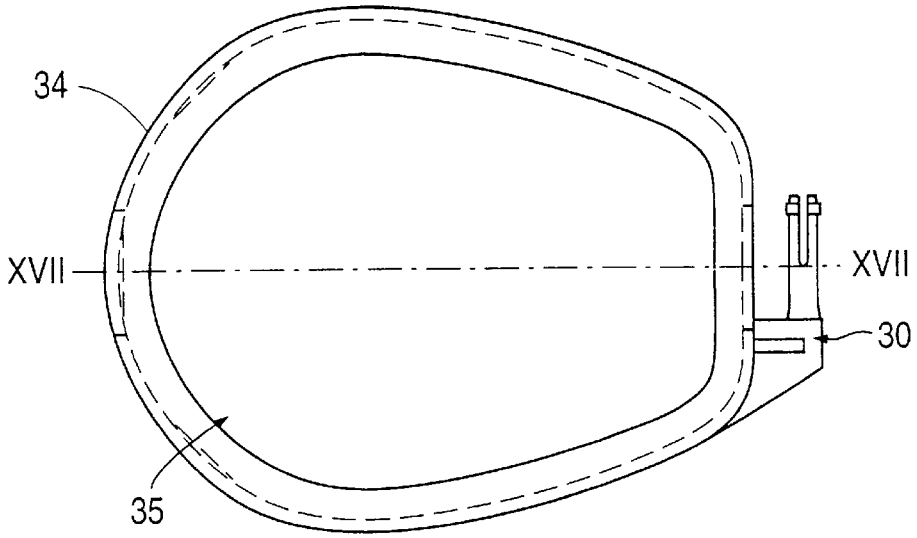
FIG. 16 is a top plan view of a modified top member of the display apparatus formed as an open frame.
Figure 17:
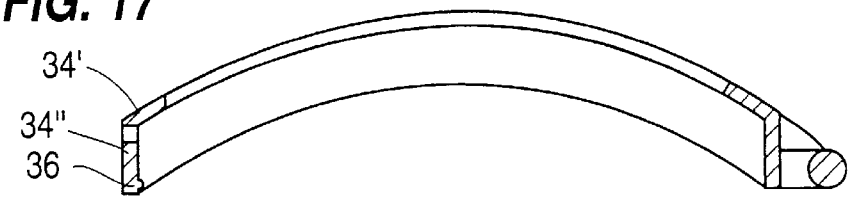
FIG. 17 is cross-section XVII—XVII of FIG. 16.
Figure 18:
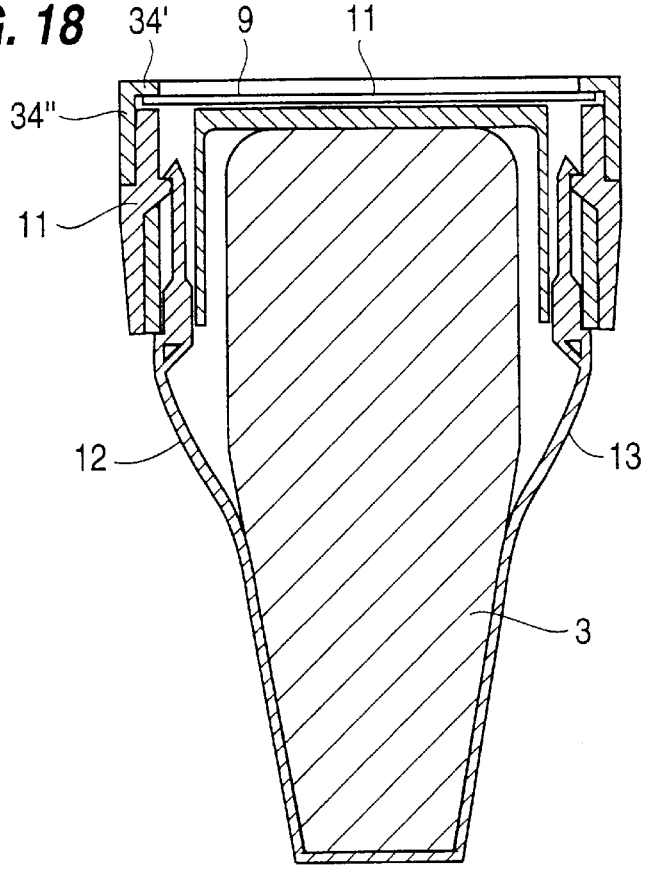
FIG. 18 is a cross-section of the display apparatus, according to the present invention fitted onto a filler gun and with a top member according to FIG. 16.

FIGS. 16–20 will now be explained with regard to the differences from what is shown and described in connection with FIGS. 13–15. Instead of the top member 27 being formed as a lid, the embodiment of FIG. 16 shows a top member 34 formed as a frame with open space 35 between opposite sides of the frame. The frame has a first element 34' for laying over a marginal edge portion of a top surface of the upper member 11, as clearly illustrated in FIG. 18, and a second element 34" integral with the first element 34' for releasably engaging upper, peripheral portion of the upper member 11. As similarly shown in FIG. 13, the second element may be provided with second portions 36 for releasable engagement with upper peripheral portion of the upper member. Similarly to that shown in FIGS. 13 and 14, the top member according to FIG. 16 is provided with a second hinge means 30.

The top member of FIG. 16 can be made of a transparent material. Alternatively, it can be made of a non-transparent material, e.g., of a color that is the same as that of the upper member 11 or a color forming a suitable contrast with the color of member 11.

FIG. 19 is a slight modification of the embodiment of FIG. 16, in that a rear end of the top member has a widened position, as seen in the longitudinal direction of the top member. The widened portion of the frame is labeled with reference number 37 and is in reality a widened portion of the first element 34' as shown and described in connection with FIG. 16 and 17. The widened portion 37 of the frame is suitable for carrying information related to type of fluid supplied from the gun, e.g., "PREMIUM" when fuel is being dispensed.

FIG. 21 is a perspective view of the embodiment according to FIGS. 16–18, and FIG. 22 is a perspective view of the embodiment according to FIGS. 19 and 20.

Figure 6:
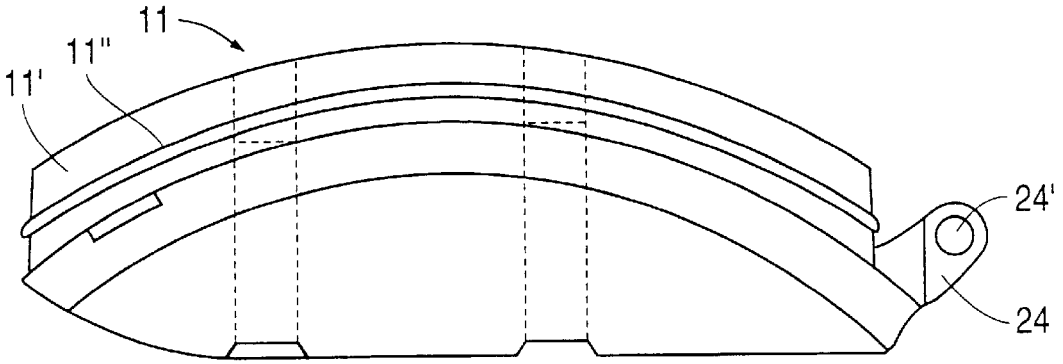
FIG. 6 is a side view of the upper member of the carrying body according to the present invention.
Figure 7:
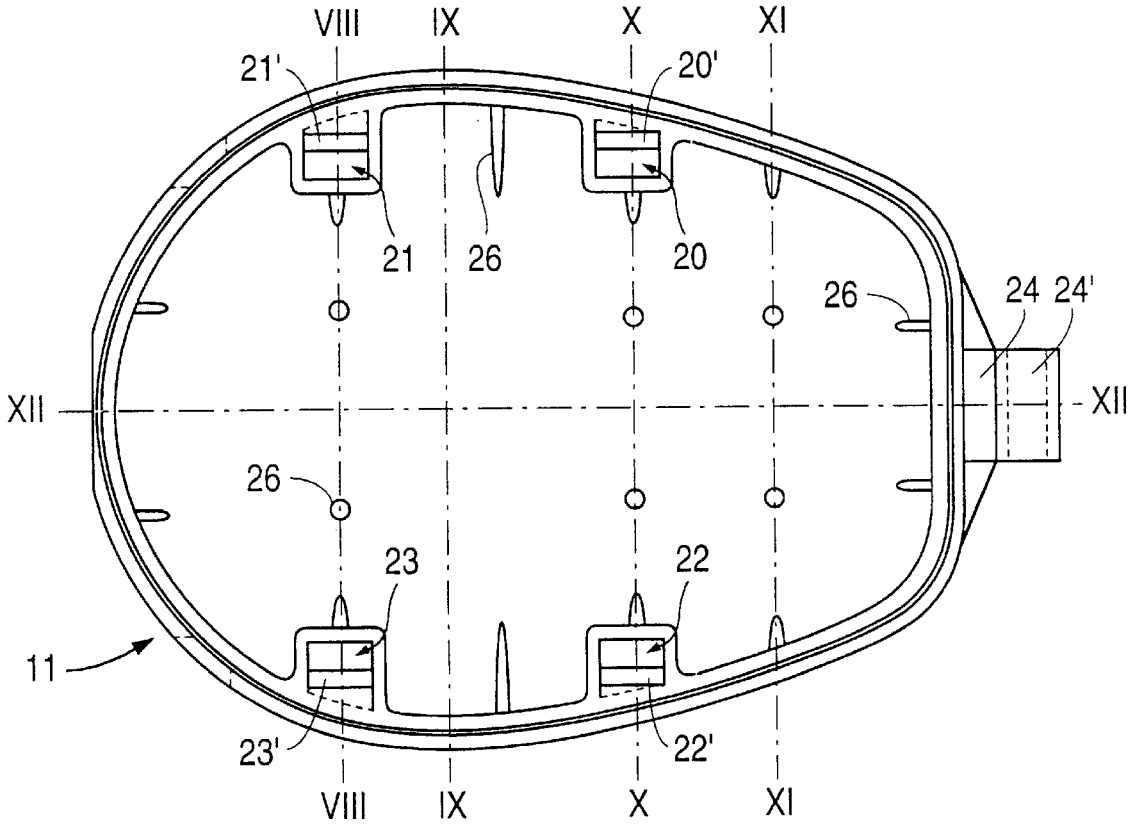
FIG. 7 is a bottom view of the upper member of the carrying body, according to the present invention.
Figure 8:
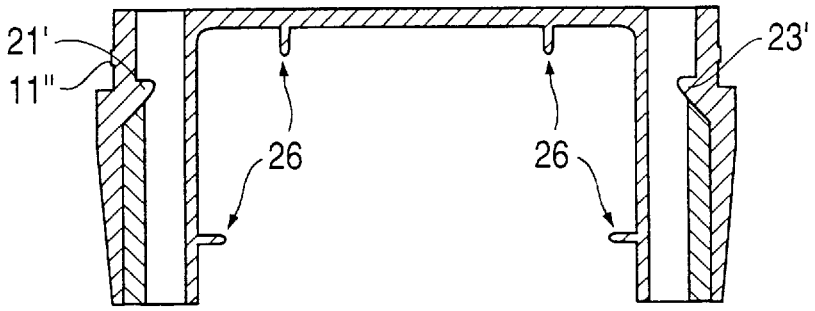
FIGS. 8, 9, 10, 11 and 12 are cross-sectional views VIII, IX, X, XI and XII of FIG. 7.
Figure 9:
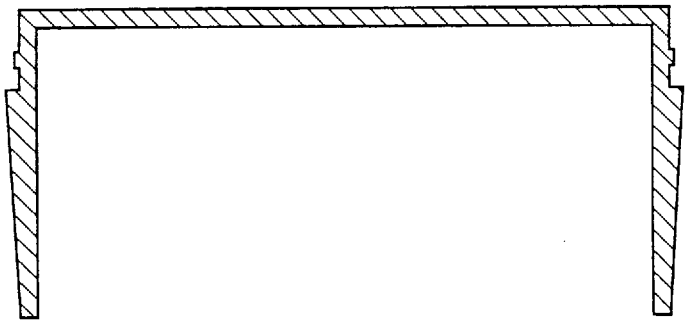
Figure 13:
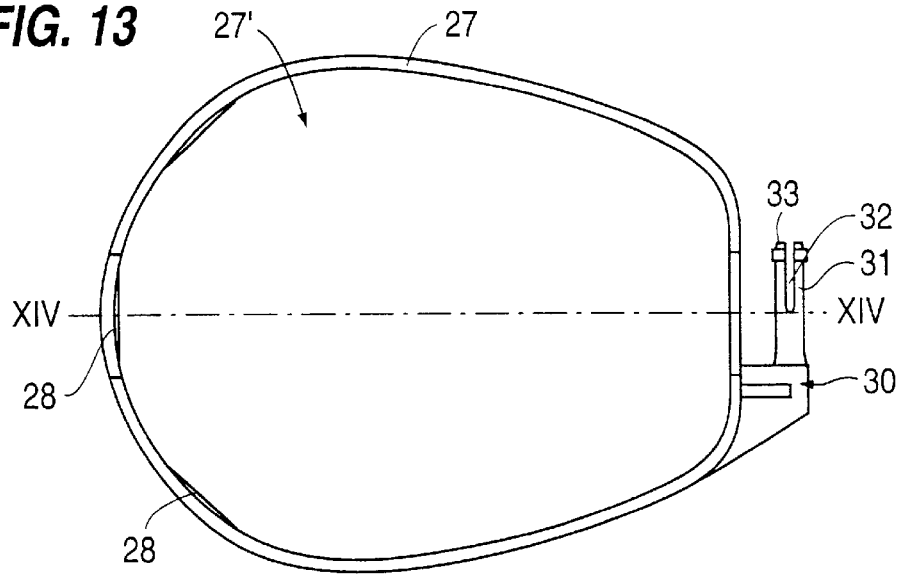
FIG. 13 is a top plan view of a top member of the display apparatus, according to the invention.
Figure 34:
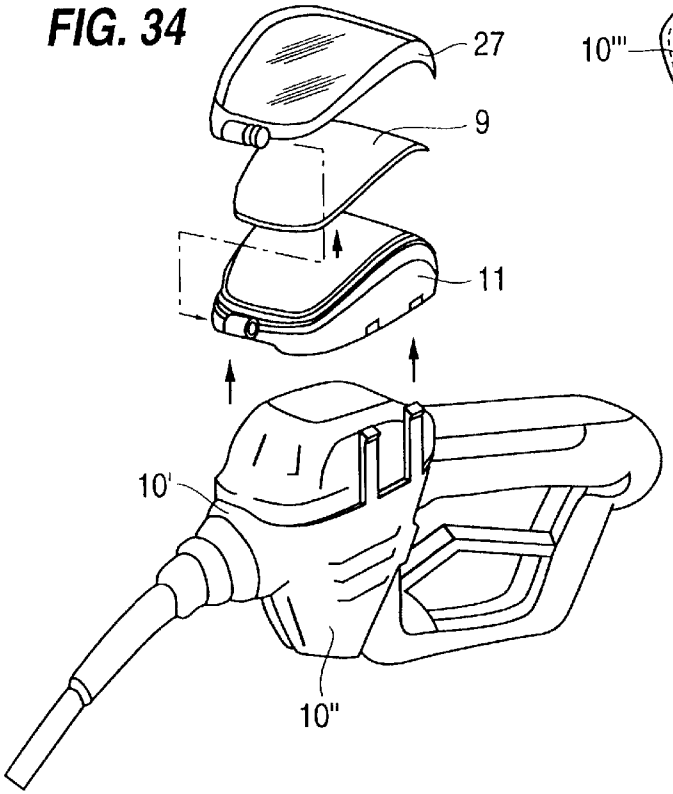

FIG. 13, with reference to FIGS. 6 and 7, shows the second hinge means being in the form of the male member 31 which is capable of releasable snap engagement with the female member 24 of the hinge connection between the upper member 11 and its top member, e.g., 27 as shown in FIG. 13 or 34 as shown in FIG. 16, or the modified version of the top member 34 shown in FIG. 19.

Figure 23:
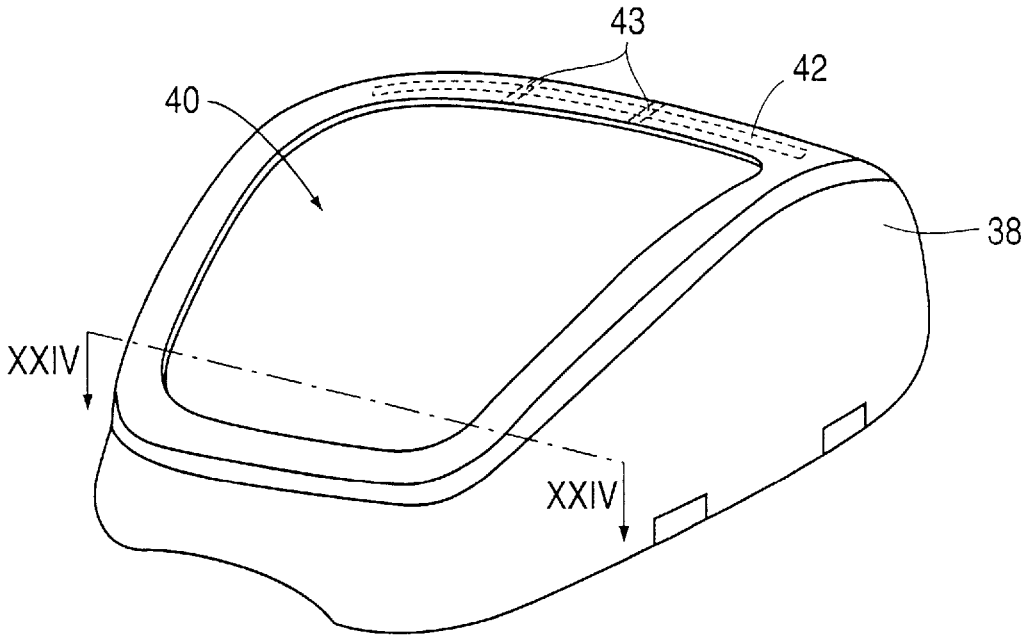
FIG. 23 shows a further embodiment of an upper member of the carrying body of the display apparatus according to the present invention, with an integral frame structure at the top surface of the upper member.
Figure 24:
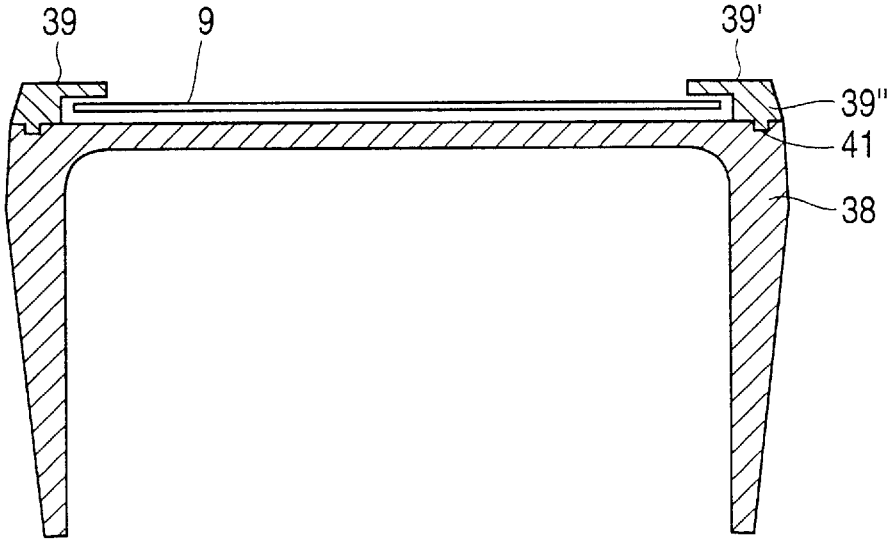
FIG. 24 is cross-section XXIV—XXIV of FIG. 23.
Figure 25:
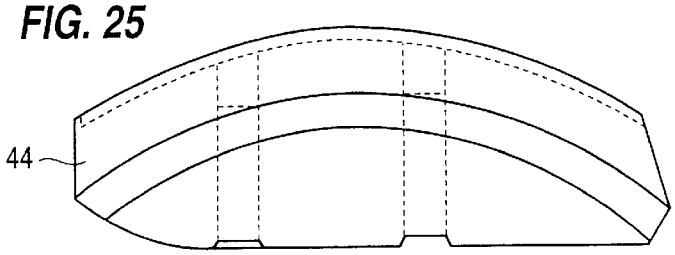
FIGS. 25, 26 and 27 are side view, top view, and perspective view, respectively, of a further modified upper member of the carrying body.

A modified version of the upper member 11 is shown in FIGS. 23 and 24, the modified upper member being denoted by reference number 38. The upper member 38 has along its peripheral outline a frame member 39 formed with open space 40 between opposite sides of the frame 39. The frame has a first element 39' located over a marginal top edge portion of the upper surface of the upper member 38, and a second element 39" integral with the first element 39'. The second element is preferably integral with the upper surface of the upper member, e.g., by welding or through the use of suitable adhesive. In order to properly locate the frame 39 onto the upper member 38, e.g., during welding or other operation for joining the two male/female members, denoted by reference numeral 41 may be provided on the frame 39 and the upper member 38, respectively.

To provide insertion of a message card 9 in the space between the upper surface of the upper member 38 and the first element 39' of frame 39, a slot 42 may be provided as shown, e.g., by dotted lines on FIG. 23, the slot being provided suitably in the second element 39" of the frame 39.

Alternatively, the first element 39' of the frame 39 may have a removed section 43 to facilitate insertion and removal of the message card 9.

An additional modification of the upper member 11 is shown and described with reference to FIGS. 25–29. In this embodiment, the upper member is labeled with reference numeral 44. It has a top surface 44' and, along at least a portion of the peripheral edge of the top surface, an upwardly extending rim 45. The rim is suitably only a few millimeters high, maybe even less. Means in the form of studs 46 protrude upwardly from the surface 44', the protruding means 46 having a substantially arrow-shaped configuration, a straight upright portion thereof having a height substantially equal to the thickness "d" of the message card 9.

Figure 27:
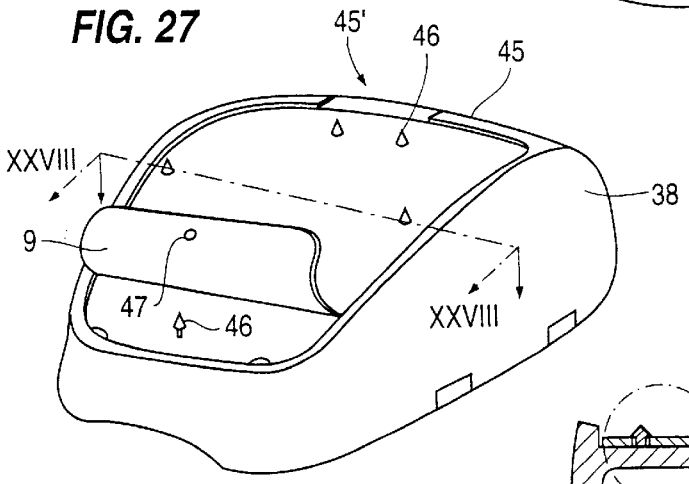
Figure 28:
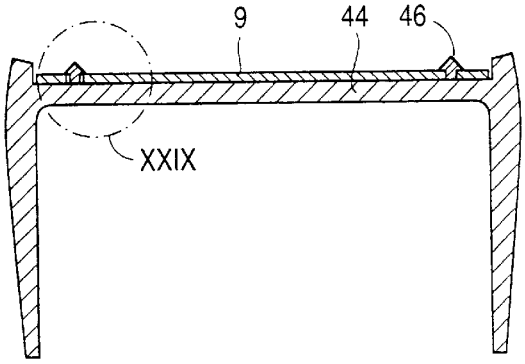
FIG. 28 is cross-section XXVII—XXVII of FIG. 27.
Figure 29:
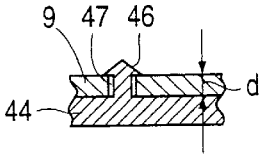
FIG. 29 is an enlarged view XXIX of FIG. 28.

When the message card 9 is positioned inside the inner circumference of the rim 45, as indicated on FIG. 27, holes 47 provided in the message card 9 are brought into snap-like engagement with the arrow-shaped studs 46. Thus, the message card 9 is held suitably in place on the upper member 44. To provide for drainage of any rain water when the gun is located on the fuel pump between filling operations, the rim 45 is suitably provided with an opening 45' as indicated in FIG. 27. The opening 45' also provides for easier removal of the message card 9 when it is to be replaced by a new message card.

Figure 26:
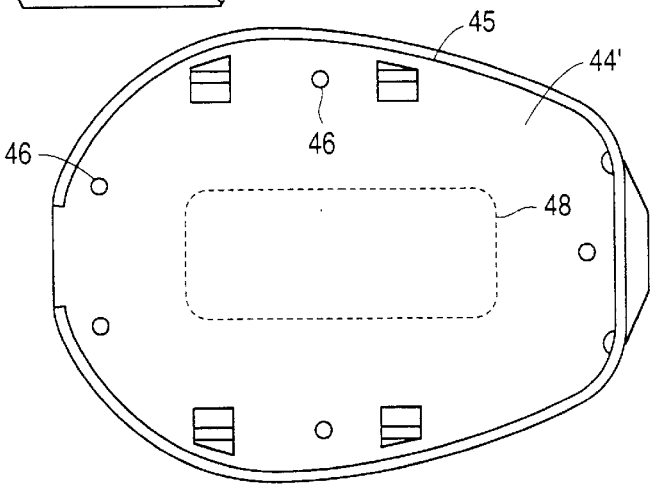

To further secure the message card 9 onto the top surface 44' of the upper member 44, a region of adhesive 48 may be applied to the upper surface 44' of the upper member 44, as indicated in FIG. 26. Alternatively, the adhesive may be available on the rear side of the message card 9 and be of a type which, for example, firmly adheres to the rear side of the message card 9, but not so firmly that it sticks to the upper surface 44' of the upper member 44.

Figure 30:
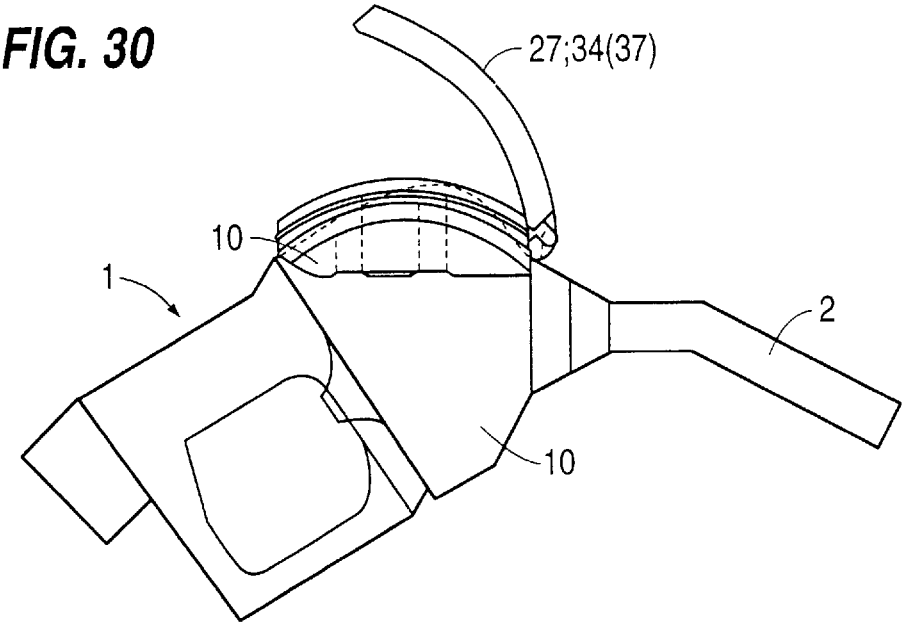
FIG. 30 is a side view of a filler gun with a two-part carrying body fitted thereon and with a pivotally connected top member fitted onto the carrying body.

FIG. 30 illustrates how the display apparatus according to the present invention and in accordance with the embodiments shown and described in connection with FIGS. 1–22 appears in a side view when mounted on a filler gun.

Figure 31:
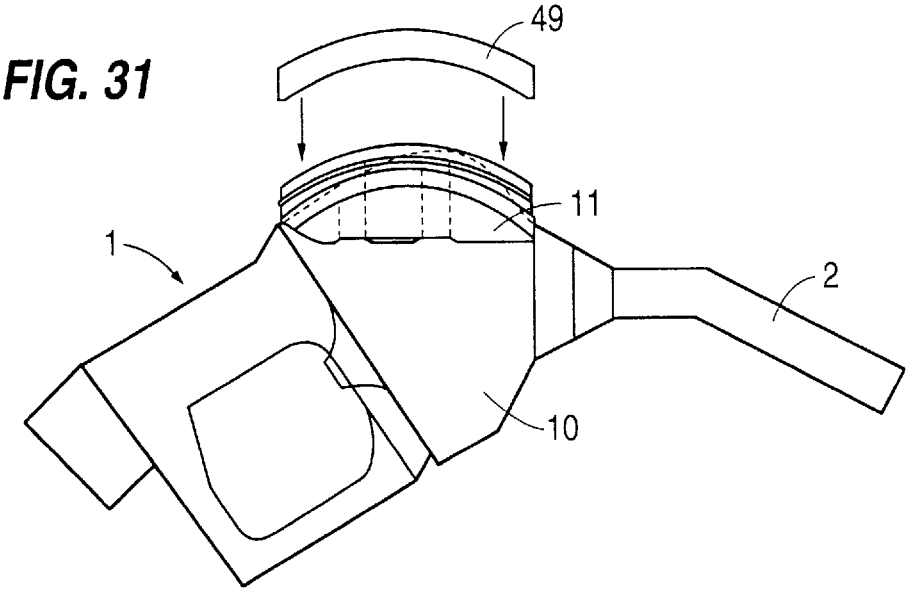
FIG. 31 is a side view of a filler gun with a two-part carrying body fitted thereon, and with a top member engageable with an upper part of the carrying body.

FIG. 31 illustrates that the top member 27; 34 (and 37) could be replaced by a top member 49 having no pivotable connection with the upper member 11. In such a variant, the hinge means 24, 30 are not present.

Figure 32:
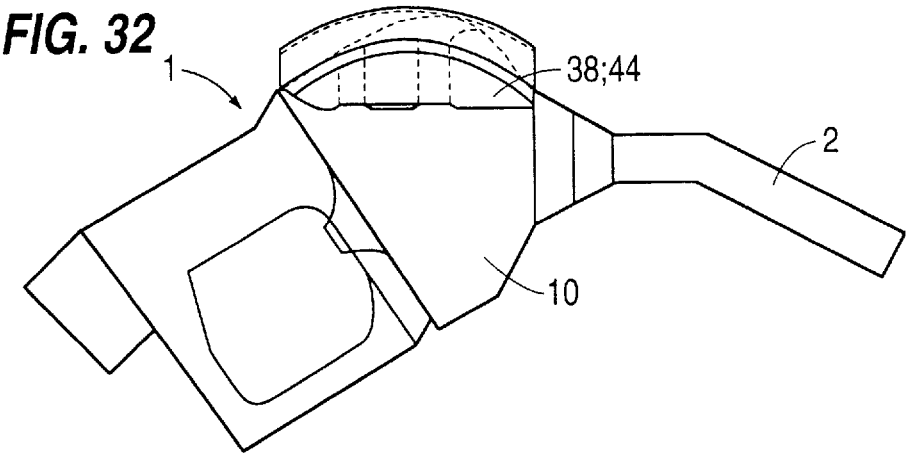
FIG. 32 is a side view of a filler gun with a two-part carrying body fitted thereon, and in accordance with the embodiments shown in FIGS. 23, 24 and 25–29.

FIG. 32 illustrates a side view of the embodiments according to FIGS. 23, 24 and 25–29.

In connection with the description of FIGS. 1 and 2, it should be noted that the side panels 12, 13 at the front region have edges which mate when the panels are brought to lie against the gun head. Until such moment, the edges are spaced apart. However, in a modified embodiment of the lower member 10, denoted by reference numeral 10*a* in FIGS. 33 and 35, it is proposed, to let the two side panels 12, 13 be integrally joined at a front region thereof. Suitably, the front region of the two side panels is above, as indicated by reference number 10' and below as indicated by reference number 10" a front opening 10'" in the lower member, through which the fluid gun nozzle 2 extends when the lower member 10*a* is brought into engagement with the gun head 3 on the filler gun 1, as illustrated on FIG. 33.

Figure 36:
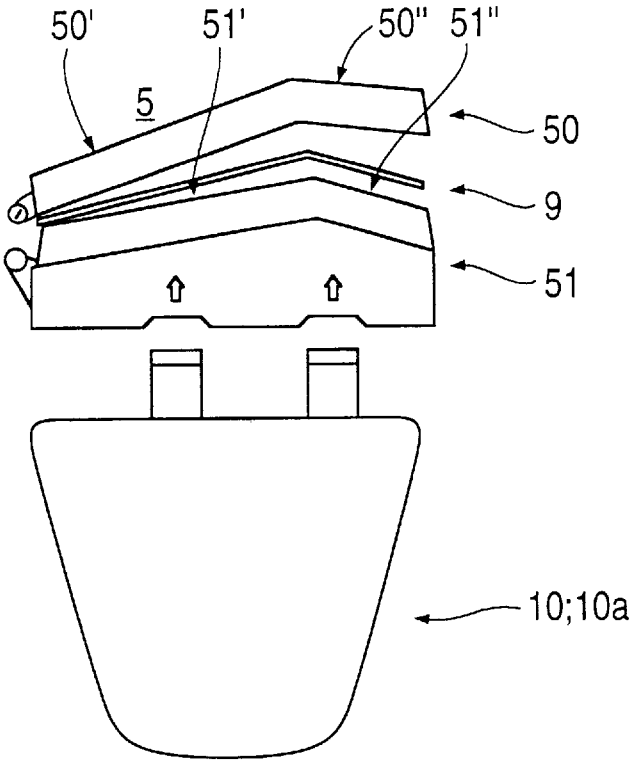
FIG. 36 illustrates a further modification of the two piece carrying body and the top member.

FIGS. 12, 14, 17 and 20, show that both the upper surface of the upper member as well as the top member have a curved configuration along its length. However, it is readily conceivable that the top member, as indicated by reference number 50 in the side view of FIG. 36 could have two substantially planar sections 50' and 50" mutually forming an obtuse angle. Similarly, the upper member, here labeled as 51 can have a top surface of similar configuration seen along its length, i.e., two substantially planar, upper surfaces 51' and 51" forming an obtuse angle. Contrary to a conventional carrying body for a display apparatus which is removably attachable to the filler gun of a fluid pump, the carrying body, in this particular invention a two-piece carrying body, is made of a substantially hard plastic material. As an example, a suitable material would be, e.g., polyamide. In a prototype, polyamide 66 has proved to be a suitable plastic material.

The top member 27; 34 (37); 49; 50 is suitably made of a substantially hard plastic material which may be transparent or non-transparent. A type of material such as polycarbonate has proved to be suitable in connection with a prototype made of the present apparatus. Suitably, the polycarbonate could be, e.g., of the make LEXAN®, MAKROLON®, GRILIAMID® or other suitable make.

Figure 33:
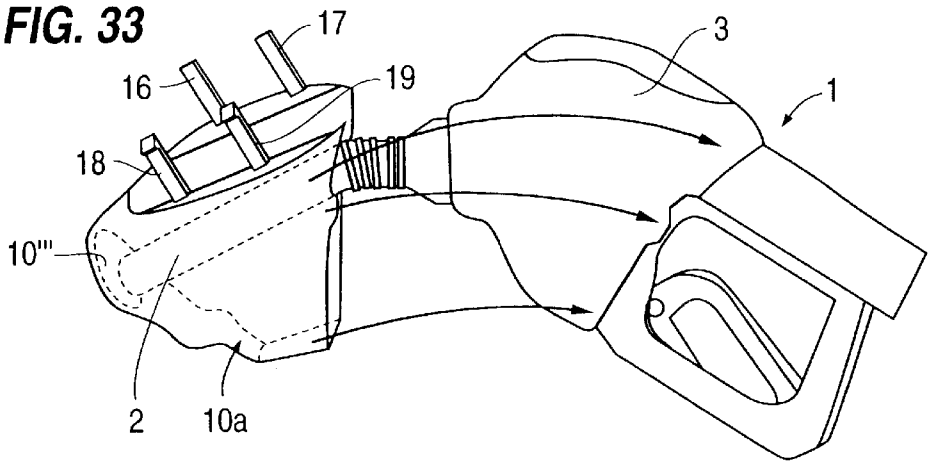
FIGS. 33–35 illustrate fitting of the lower member of the carrying body onto the filler gun when the lower member at its front end region has its side panels integrally joined.
Figure 35:
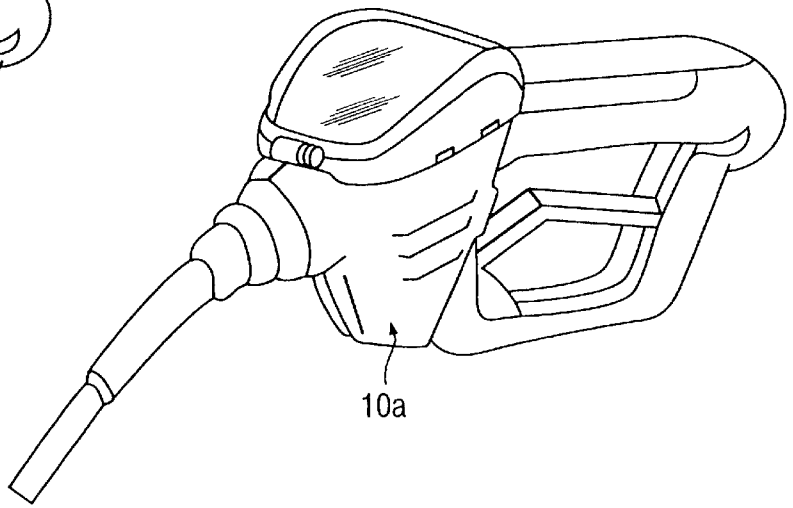

In the embodiment of the lower member 10*a* as described in connection with FIGS. 33–35, when the lower member is to be fitted onto the gun head of the filler gun 1, the rear portions of the side panels 12, 13 may be pushed slightly away from each other to more easily push and enter the lower member 10*a* onto the filler gun. Although the lower member is made of a substantially hard plastic material, the wall thickness of the lower member is of such dimension that manipulation of the side panels is possible.

With reference to FIG. 7 of the drawings, and also FIG. 26, and further with reference to FIGS. 13, 16, 19, 21, 22 the upper member 25 shown has a peripheral outline of substantially oval form. Further, the top member also has a peripheral outline of substantially oval form.

Suitable dimensions of the top member in the longitudinal direction are in the range of 110–140 millimeters and a maximum transverse dimension in the range of 80–105 millimeters. Preferably, the longitudinal dimension is in the range of about 120–135 millimeters and the maximum transverse dimension is in the range of about 90–100 millimeters.

Figure 37:
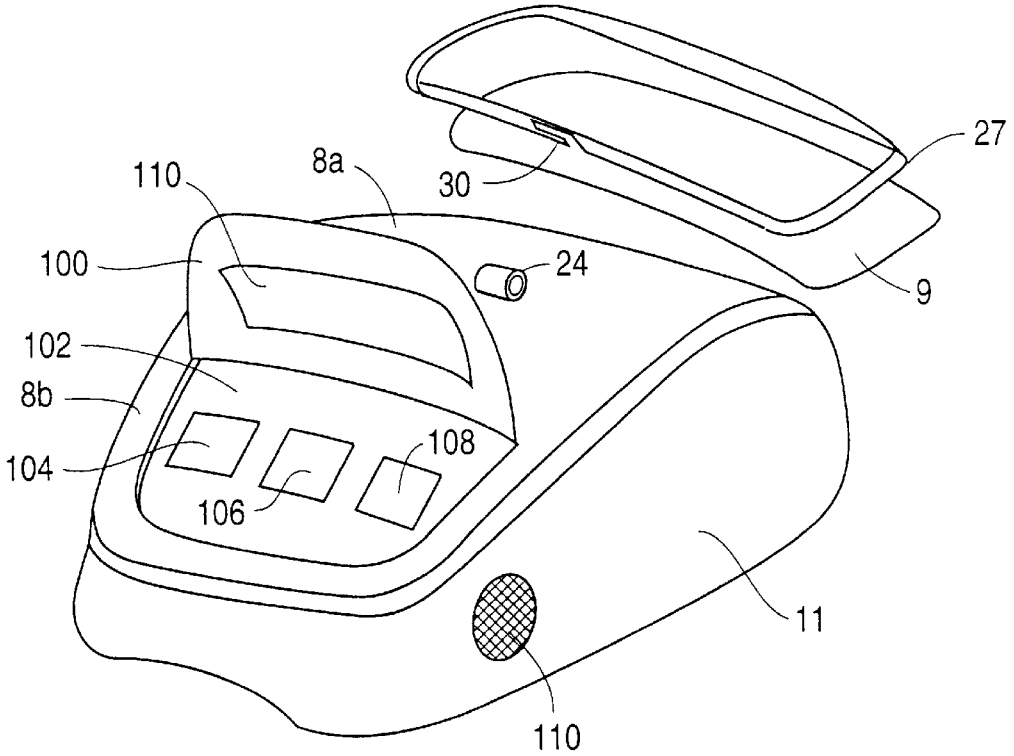
FIG. 37 is a perspective view of a first embodiment of a display device having a communication apparatus mounted in the carrying body.
Figure 38:
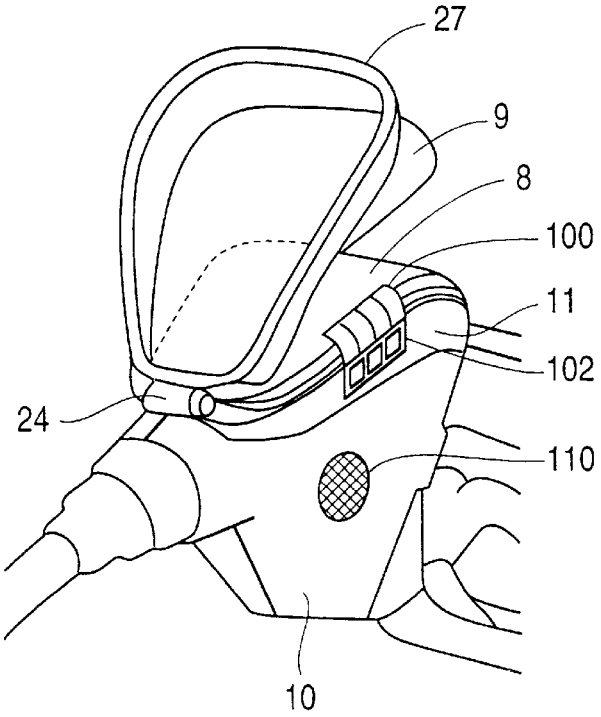
FIG. 38 is a perspective view of a second embodiment of a display device having a communication apparatus mounted in the body.

In accordance with the invention, a communication housing is defined in the carrying body. As shown in FIGS. 37 and 38 carrying body 7 includes a pivotable door 100 covering a trough or housing 102.

The precise location of housing 102 and door 100 are not critical. In the embodiment depicted in FIG. 37, the display surface 8 is divided into a first portion 8*a*, covered by a smaller top member 27 and message card 9. The display surface 8 further includes a second portion 8*b*. Housing 102 is defined beneath the second portion 8*b* of display surface 8, and covered by pivotal door 100.

In an alternate embodiment, as shown in FIG. 38, the housing 102 is defined in a side of upper member 11, and covered by door 100. It is further possible, although not shown, to provide the housing 102 and door 100 at any suitable location in lower member 10 of the carrying body.

In accordance with the invention, a communication apparatus is provided in the housing. The communication apparatus can include any one or more of a radio transmitter assembly, a radio receiver assembly, or a recorder. As shown in FIG. 37, housing 102 holds a radio transmitter 104, a radio receiver 106, and a recorder unit 108. These components are depicted schematically as boxes in FIG. 37, but can be any type of well known transmitter, receiver, or recorder. Moreover, the embodiment of FIG. 37 can be modified as desired to include a standalone transmitter, a standalone receiver, a transmitter/receiver pair, a standalone recorder, or any other possible combination.

One or more speaker units 110 are also provided. Speakers 110 are well known components, capable of converting acoustic waves to electrical signals, and vice versa. Preferably, each speaker 110 is capable of both transmitting and receiving sound. However, separate transmitting and receiving speakers 110 may also be provided. The invention is not limited to any particular location for speakers 110, or to any specific number of speakers 110. For example, the embodiment of FIG. 37 has a speaker 110 positioned on the side of upper member 11 of the carrying body, whereas the embodiment of FIG. 38 has speaker 110 positioned on a side of lower member 10 of the carrying body. FIG. 37 also depicts a speaker 110 positioned on door 100.

Radio transmitter assembly 104 enables the consumer to transmit vocal messages to the attendant at a remote location at the service station. Radio receiver assembly 106 enables the consumer to receive vocal messages from the attendant at the remote location. Recorder 108 can record messages advertising products, or services, giving vocal instructions to the consumer on filler gun operation, and so forth.

In the above described embodiments, the carrying body is releasably attachable to the filler gun. The display device including a communication apparatus is not limited only to detachable display devices, however. It is within the scope of the invention to provide the communication apparatus with a display device that is an integral part of the gun head itself.

Figure 39:
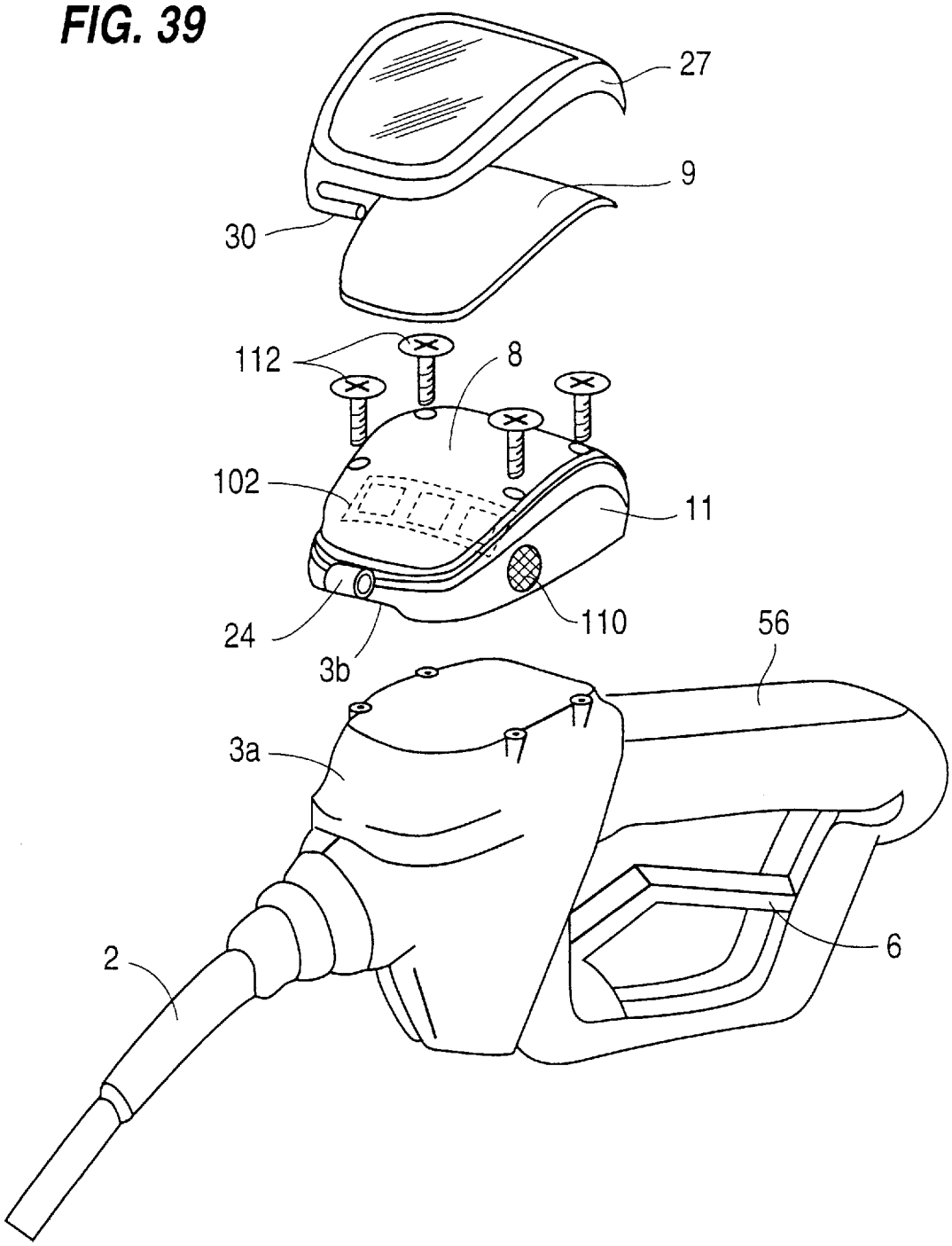
FIG. 39 is a perspective exploded view of a display device integrated with a filler gun head, including a communication apparatus.

As shown in FIG. 39, gun head 3 includes a lower portion 3*a*, comprising the side portions, and an upper portion 3*b*, corresponding generally to upper member 11 of the detachable carrying body of the previous embodiments. In the embodiment of FIG. 39, upper gun head portion 3*b* is attached to lower portion 3*a* with a plurality of threaded fasteners 112, but this is not required. Upper portion 3*b* and lower portion 3*a* can be welded together or molded as an integral unit.

In the embodiment of FIG. 39, the top member 27 is pivotally attached to upper portion 3*b* of the gun head, holding a replaceable message card 9 between the top member 27 and display surface 8. A door 100 is provided in upper portion 3*b* of the gun head, covering the communication housing 102. One or more communication assemblies are provided in housing 102, and sound is transmitted through speaker 110.

Additional advantages and modifications will readily occur to persons of ordinary skill in the art. The invention, therefore, is not limited to the specific details or the present preferred embodiments disclosed above. Departures may be made from such details without departing from the scope of the inventor's concept. The scope of the invention is limited only by the attached claims and their equivalents.

What is claimed is:

1. A display device attachable to a fluid filler gun, the filler gun including a barrel, a gun head, and a handle, the display device comprising:

a carrying body removably attachable to the gun head, said carrying body including side portions and an upper portion having an upper surface;

a frame attached to the upper portion of said carrying body, said frame and the upper surface defining a display portion for holding a removable display placard;

a communication housing defined in said carrying body; and an interactive voice communication apparatus provided in said housing.

2. The display device of claim 1, wherein the side portions and the upper portion of said carrying body defines a sleeve having two open ends, said carrying body being slidable onto the gun head, with the barrel projecting through one open end, and the handle projecting through the other open end.

3. The display device of claim 1, wherein said carrying body is made of rigid plastic.

4. The display device of claim 1, wherein said frame is removable from the upper portion of said carrying body.

5. The display device of claim 1, wherein said frame is pivotally attached to the upper portion of said carrying body.

6. The display device of claim 1, wherein the side portion and the upper portion of said carrying body comprise a molded unitary body.

7. The display device of claim 1, wherein said interactive voice communication apparatus includes a radio transmitter assembly.

8. The display device of claim 1, wherein said interactive voice communication apparatus includes a radio receiver assembly.

9. The display device of claim 1, wherein said interactive voice communication apparatus includes a recorder assembly.

10. The display device of claim 1, wherein the upper portion of said carrying body is removable from the side portions of said carrying body.

11. A display device attachable to a fluid filler gun, the filler gun including a barrel, a gun head, and a handle, the display device comprising:

a carrying body removably attachable to the gun head, said carrying body including side portions and an upper portion having an upper surface;

a frame attached to the upper portion of said carrying body, said frame and the upper surface defining a display portion for holding a removable display placard;

a communication housing defined in said carrying body; and a communication apparatus provided in said housing, wherein said communication apparatus includes a radio transmitter assembly.

12. A display device attachable to a fluid filler gun, the filler gun including a barrel, a gun head, and a handle, the display device comprising:

a carrying body removably attachable to the gun head, said carrying body including side portions and an upper portion having an upper surface;

a frame attached to the upper portion of said carrying body, said frame and the upper surface defining a display portion for holding a removable display placard;

a communication housing defined in said carrying body; and a communication apparatus provided in said housing, wherein said communication apparatus includes a radio receiver assembly.

13. A display device attachable to a fluid filler gun, the filler gun including a barrel, a gun head, and a handle, the display device comprising;

a carrying body removably attachable to the gun head, said carrying body including side portions and an upper portion having an upper surface;

a frame attached to the upper portion of said carrying body, said frame and the upper surface defining a display portion for holding a removable display placard;

a communication housing defined in said carrying body; and a communication apparatus provided in said housing, wherein said communication apparatus includes a recorder assembly.

14. A display device attachable to a fluid filler gun, the filler gun including a barrel, a gun head, and a handle, the display device comprising:

a carrying body removably attachable to the gun head, said carrying body including side portions and an upper portion having an upper surface;

a frame attached to the upper portion of said carrying body, said frame and the upper surface defining a display portion for holding a removable display placard;

a communication housing defined in said carrying body; and a communication apparatus provided in said housing, wherein the upper portion of said carrying body is removable from the side portions of said carrying body.

15. A fluid filler gun, comprising:

a barrel, a gun head, and a handle, said handle including a trigger operating a valve housed in said gun head to route fluid through said gun head and said barrel, said gun head including side walls and an upper surface;

a frame attached to the upper surface of said gun head, said frame and the upper surface defining a display portion for holding a removable display placard;

a communication housing defined in said gun head; and an interactive voice communication apparatus provided in said housing.

16. The fluid filler gun of claim 15, wherein the filler gun is a gasoline filler gun attachable to a gasoline pump.

17. The fluid filler gun of claim 15, wherein said frame is removably attached to the upper surface of said gun head.

18. The fluid filler gun of claim 15, wherein said frame is pivotally attached to the upper surface of said gun head.

19. The fluid filler gun of claim 15, wherein said interactive voice communication apparatus includes a radio transmitter assembly.

20. The fluid filler gun of claim 15, wherein said interactive voice communication apparatus includes a radio receiver assembly.

21. The fluid filler gun of claim 15, wherein said interactive voice communication apparatus includes a recorder assembly.

22. A fluid filler gun, comprising;

a barrel, a gun head, and a handle, said handle including a trigger operating a valve housed in said gun head to route fluid through said gun head and said barrel, said gun head including side walls and an upper surface;

a frame attached to the upper surface of said gun head, said frame and the upper surface defining a display portion for holding a removable display placard;

a communication housing defined in said gun head; and a communication apparatus provided in said housing, wherein said communication apparatus includes a radio transmitter assembly.

23. A fluid filler gun, comprising:

a barrel, a gun head, and a handle, said handle including a trigger operating a valve housed in said gun head to route fluid through said gun head and said barrel, said gun head including side walls and an upper surface;

a frame attached to the upper surface of said gun head, said frame and the upper surface defining a display portion for holding a removable display placard;

a communication housing defined in said gun head; and a communication apparatus provided in said housing, wherein said communication apparatus includes a radio receiver assembly.

24. A fluid filler gun, comprising:

a barrel, a gun head, and a handle, said handle including a trigger operating a valve housed in said gun head to route fluid through said gun head and said barrel, said gun head including side walls and an upper surface;

a frame attached to the upper surface of said gun head, said frame and the upper surface defining a display portion for holding a removable display placard;

a communication housing defined in said gun head; and a communication apparatus provided in said housing, wherein said communication apparatus includes a recorder assembly.

* * * * *